US005795436A

United States Patent [19]

Halm et al.

[11] Patent Number: 5,795,436

[45] Date of Patent: Aug. 18, 1998

[54] ADHESIVE STICK WITH PLUNGER-SHAPED RETAINING DEVICE FOR THE STICK COMPOSITION

[75] Inventors: Hans Halm, Herne; Wilhelm Werhahn, Baden-Baden; Klaus Eichler, Buhl; Hans-Martin Kapsa, Ottersweiller, all of Germany

[73] Assignee: Uhu GmbH, Baden, Germany

[21] Appl. No.: 682,113

[22] Filed: Jul. 17, 1996

[30] Foreign Application Priority Data

Feb. 8, 1996 [DE] Germany ..... 196 04 626.2

[51] Int. Cl.[6] ..... B32B 31/00

[52] U.S. Cl. ..... 156/579; 222/324; 222/386; 222/470

[58] Field of Search ..... 156/578, 579; 222/209, 323, 324, 386, 469, 470

[56] References Cited

U.S. PATENT DOCUMENTS

| | | | |
|---|---|---|---|
| 4,648,532 | 3/1987 | Green | 222/386 X |
| 4,664,299 | 5/1987 | Goncalves | 222/386 X |
| 4,852,772 | 8/1989 | Ennis, III | 222/386 |
| 5,125,539 | 6/1992 | Schneider | 222/209 X |
| 5,221,348 | 6/1993 | Masano | 156/578 X |
| 5,273,190 | 12/1993 | Lund | 222/386 X |
| 5,360,146 | 11/1994 | Ikushima | 222/386 |
| 5,368,201 | 11/1994 | Fuchs | 222/386 X |
| 5,373,969 | 12/1994 | Takemura | 222/386 X |

*Primary Examiner*—David A. Simmons
*Assistant Examiner*—Paul M. Rivard
*Attorney, Agent, or Firm*—Graham & James LLP

[57] ABSTRACT

The invention relates to an adhesive stick having a plunger anchoring the stick composition and a sleeve surrounding the stick composition, in which the propelling device for the upward and downward moving of the stick composition, which device at the same time serves as the actuating element, is formed together with the sleeve and the plunger as a one-part injection moulding. This propelling and actuating element (1) is designed in the form of a plate and is provided with lateral reinforcing webs (2) and is bonded on both sides to the plunger plate (0); it has at the vertex a pressure plate (3). Anchorage elements for the stick composition on the plunger plate (0) are designed in the form of bristles (6).

9 Claims, 6 Drawing Sheets

ADHESIVE STICK WITH PLUNGER-SHAPED RETAINING DEVICE FOR THE STICK COMPOSITION

In the production of adhesive sticks of the previously customary type, which have a rotatable base part with a rotary spindle which engages in a retaining device for the stick composition, designed for example in the form of an anchorage plate, a plunger or a cup, the retaining device being securely fitted into an outer sleeve which protects the stick composition from drying out and from damage, difficulties have arisen in rapid assembly before filling of the sticks.

The outer sleeve, the retaining device and the base part with the rotary spindle are produced separately and then assembled. In this case, for assembly, the rotary spindle must be turned rapidly and very accurately through a centered clearance in the retaining device, which has been inserted beforehand into the outer sleeve, while at the same time the outer sleeve locks with its outer rim on the base part.

Since considerable forces occur thereby, the number of damaged retaining devices and damaged rotary spindles rejected is appreciable for commercial reasons, in particular also from the point of view of recycling reject products.

Furthermore, it has been found in the use of such telescopic sticks that the rotary spindle engaging in the core of the stick composition reduces the volume of adhesive composition available because of the space required for the said spindle.

Also, the length of advancement of the stick is restricted by the pitch of the spindle, i.e. the greater the length of advancement desired by the consumer, the greater the number of turns of the spindle required for this.

It would also be desirable with regard to the mechanism of the displacing movement to depart from the turning movement which is transferred to a double-threaded spindle.

The object of the invention was therefore to solve the assembly problem discussed above and also the problems of the propelling mechanism.

The principle of the solution according to the invention is based on the idea of effecting the upward and downward moving of the stick by means of a propelling and actuating element which is designed in the form of a plate, is fastened on both sides to the plunger plate via reinforcing webs and has at the vertex a pressure plate, a surrounding surface being provided on the propelling element above the plunger plate and the plunger plate having on its side protruding into the sleeve enclosing the stick composition anchorage elements for the stick composition in the form of bristles, with the further feature that the plate-shaped propelling and actuating element, the plunger with the plunger plate and the anchorage bristles and the sleeve form a unit in the form of an injection moulding.

The sleeve may in this case have a circular cross-section or an elliptical cross-section. A cross-section in the form of an ellipse has the advantage that the user can produce a narrow adhesive strip or a wide adhesive strip, depending on the handling of the stick.

After ejection from the injection-moulding machine, the injection moulding expediently has at the lower edge of the plunger plate sprue links, by means of which it is firmly connected to the inside of the sleeve. Very advantageously, the number of these links is four.

The lower open end of the sleeve is expediently provided with a snap ring for fitting on a fit-on cap, in order in this way to prevent the adhesive stick from drying out or being damaged. This fit-on cap expediently has gripping ribs on its outside.

The invention is explained in more detail with reference to the drawings.

Figure 1:
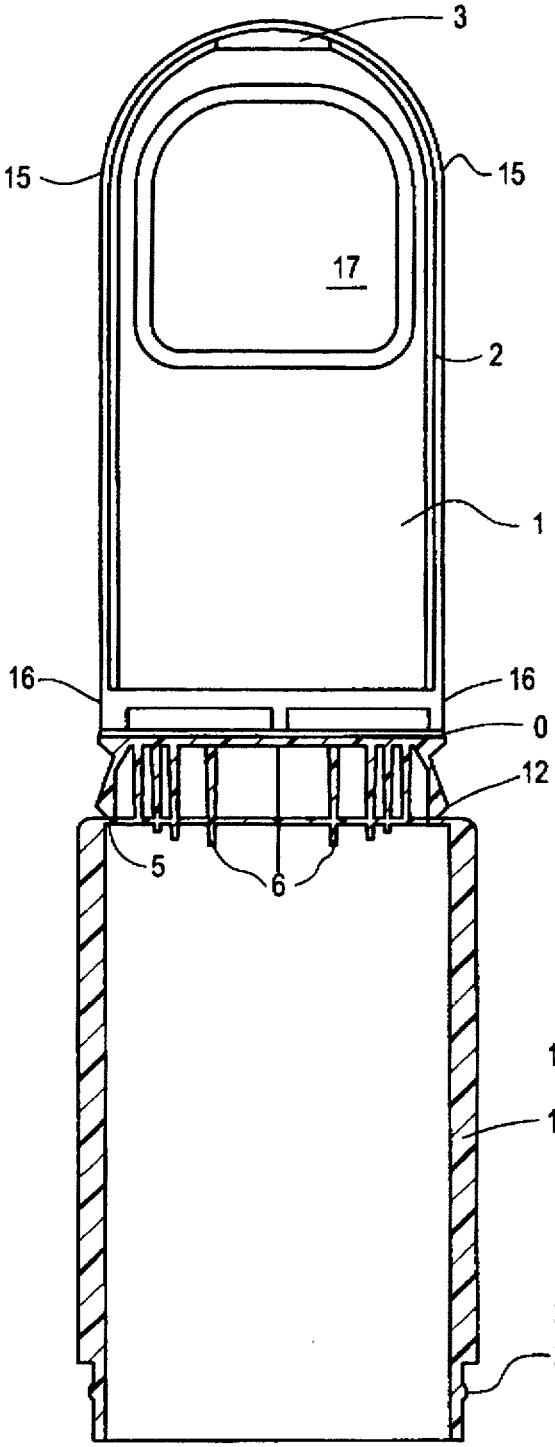
FIG. 1 shows the stick as an injection moulding, namely the sleeve, which holds the stick composition, with moulded-on plunger in section.

As FIGS. 1 to 5 show, the plate-shaped element (1) is connected on both sides to a plunger plate (0) via reinforcing webs (2), the plunger forming at its lower edge, via sprue links (5), a unit with the sleeve (10), which has a snap ring (20). The plunger plate (0) has an arrangement of bristles (6), which serve as securing elements for the stick composition. The plate-shaped element (1) is provided at the vertex with the pressure plate (3). Preferably, the plate-shaped element (1) has at the upper end a gripping cavity (17) which accommodates one or two fingers, so that the element can easily be moved in the axial direction. The surface (4) which surrounds the top of the plunger plate (0) stabilizes the plunger during use and counteracts any tilting thereof.

Figure 2:
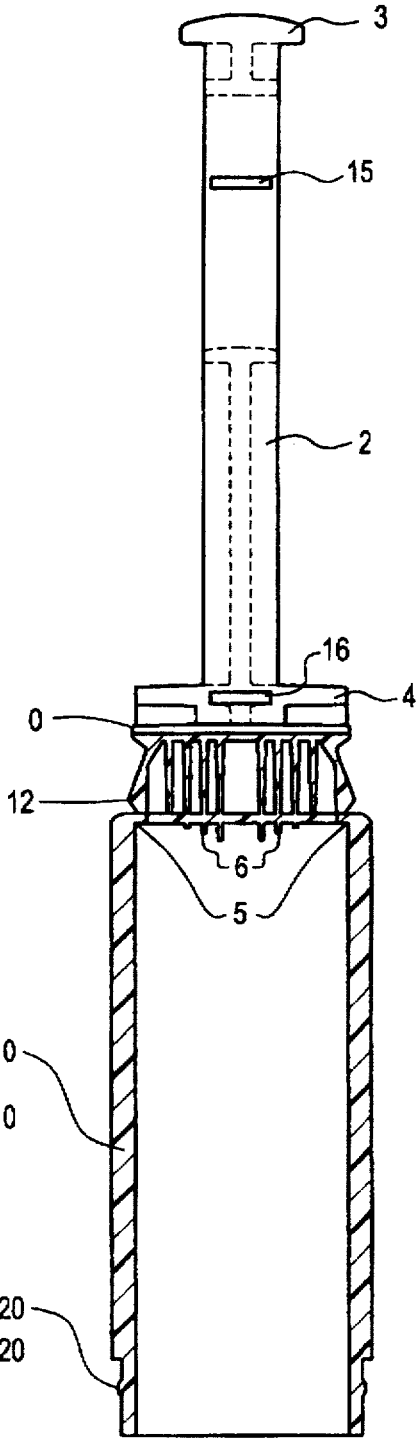
FIG. 2 shows the stick with moulded-on plunger in section from the side.
Figure 3:
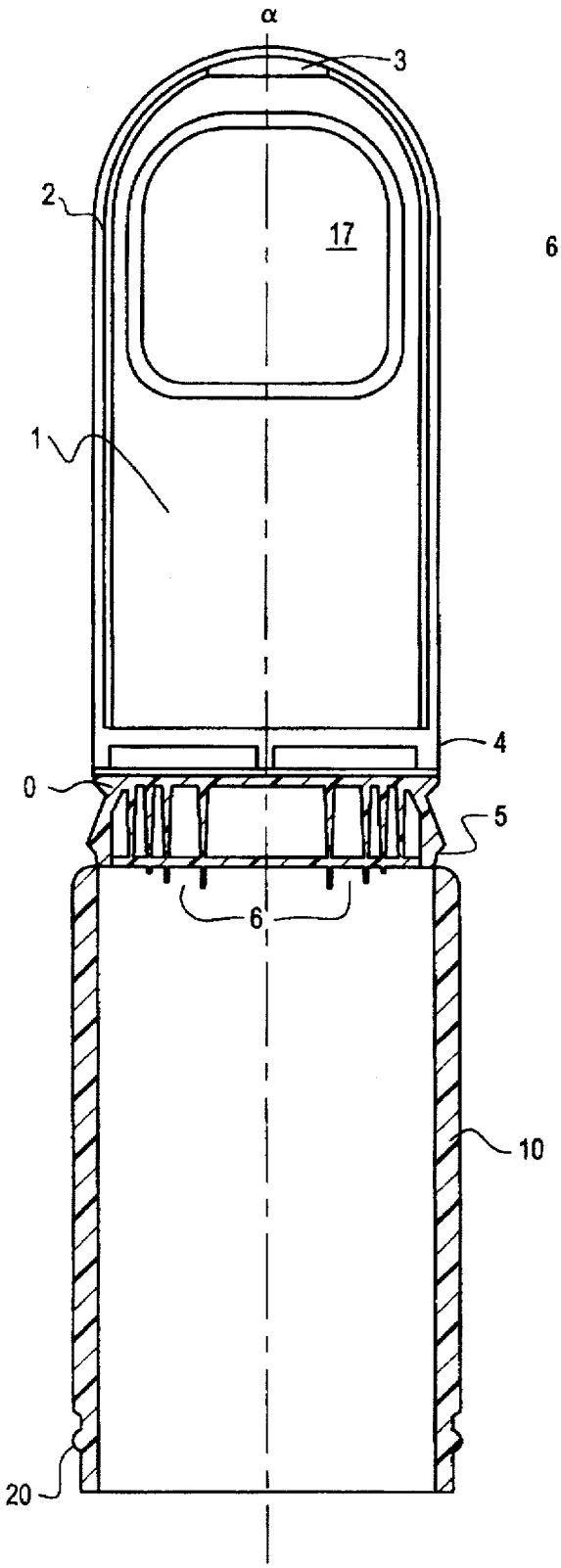
FIG. 3 shows a section of the stick as an injection moulding.
Figure 4:
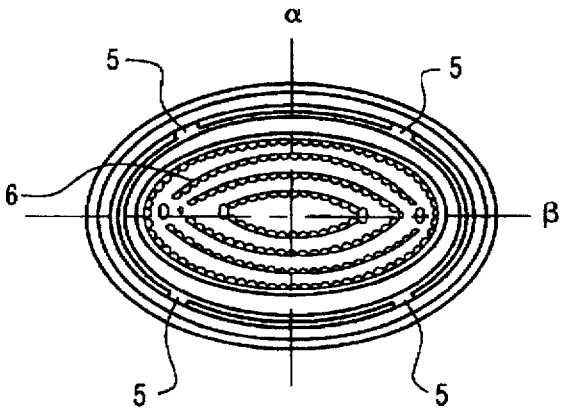
FIG. 4 shows a section at the level of the bristles from below.
Figure 5:
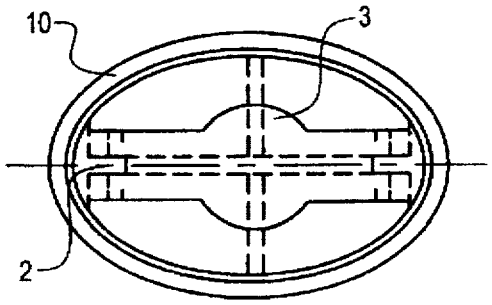
FIG. 5 shows the stick in a view from above.

FIGS. 1, 2 and 3 show the one-part injection moulding as it is when it drops out of the mould. For filling (cf. FIG. 6), the sprue links (5) are broken off and the plunger plate is pushed some way into the sleeve.

Figure 7:
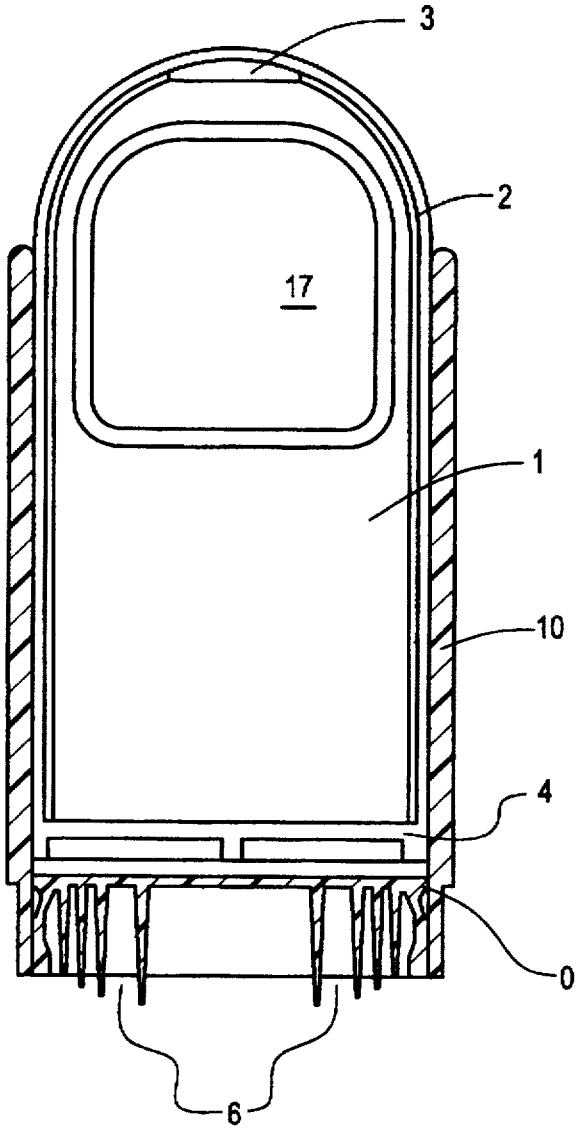
FIG. 7 shows a section of the stick in the state of maximum use (final state)

Very expediently, the plate-shaped propelling element (1) has in each case bosses (15) in the upper part of the reinforcing webs (2), by means of which bosses the propelling element is prevented from being pushed too far through the sleeve (10) when it is moved axially (cf. FIG. 7).

Figure 6:
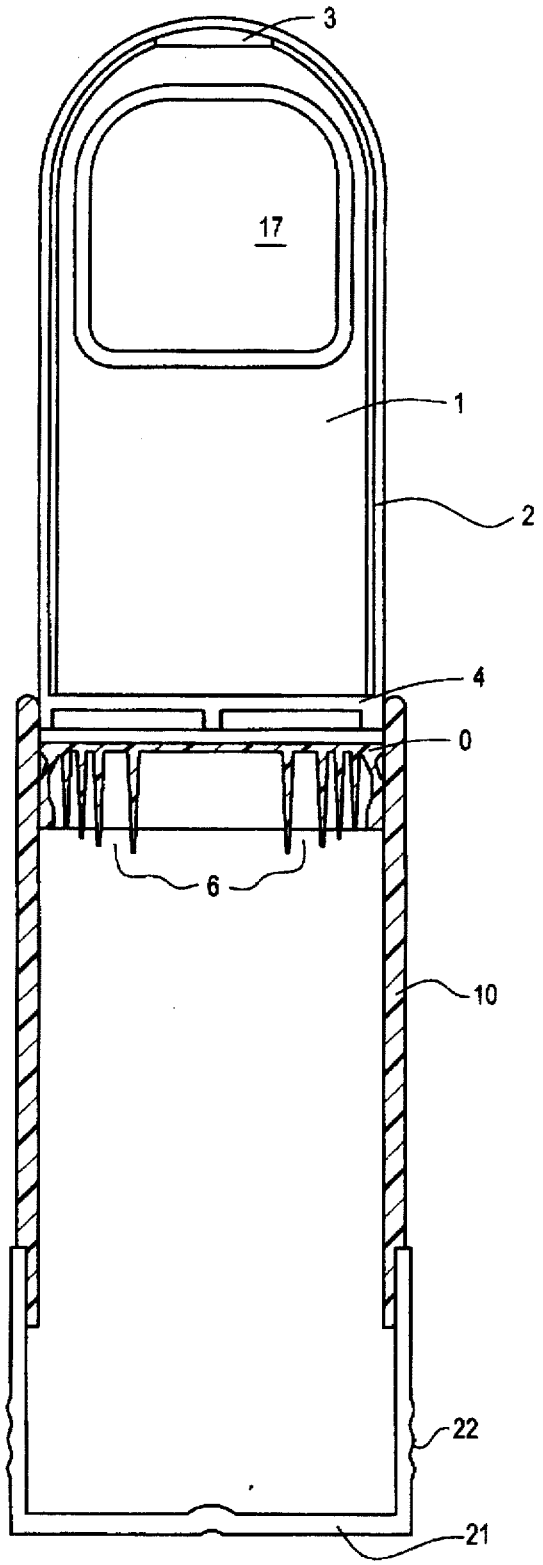
FIG. 6 shows a section of the stick in the state for use.

Furthermore, bosses (16) are also provided on the circumference of the surface (4), which have the function of acting as retraction barriers, so that the plunger is not pulled out of the top of the sleeve (10) after the stick has been used (cf. FIG. 6).

A particular development of the plunger plate (0) ensures that the stick composition remains firmly connected to the base of the plunger when the propelling element (1) is moved axially.

Figure 8:
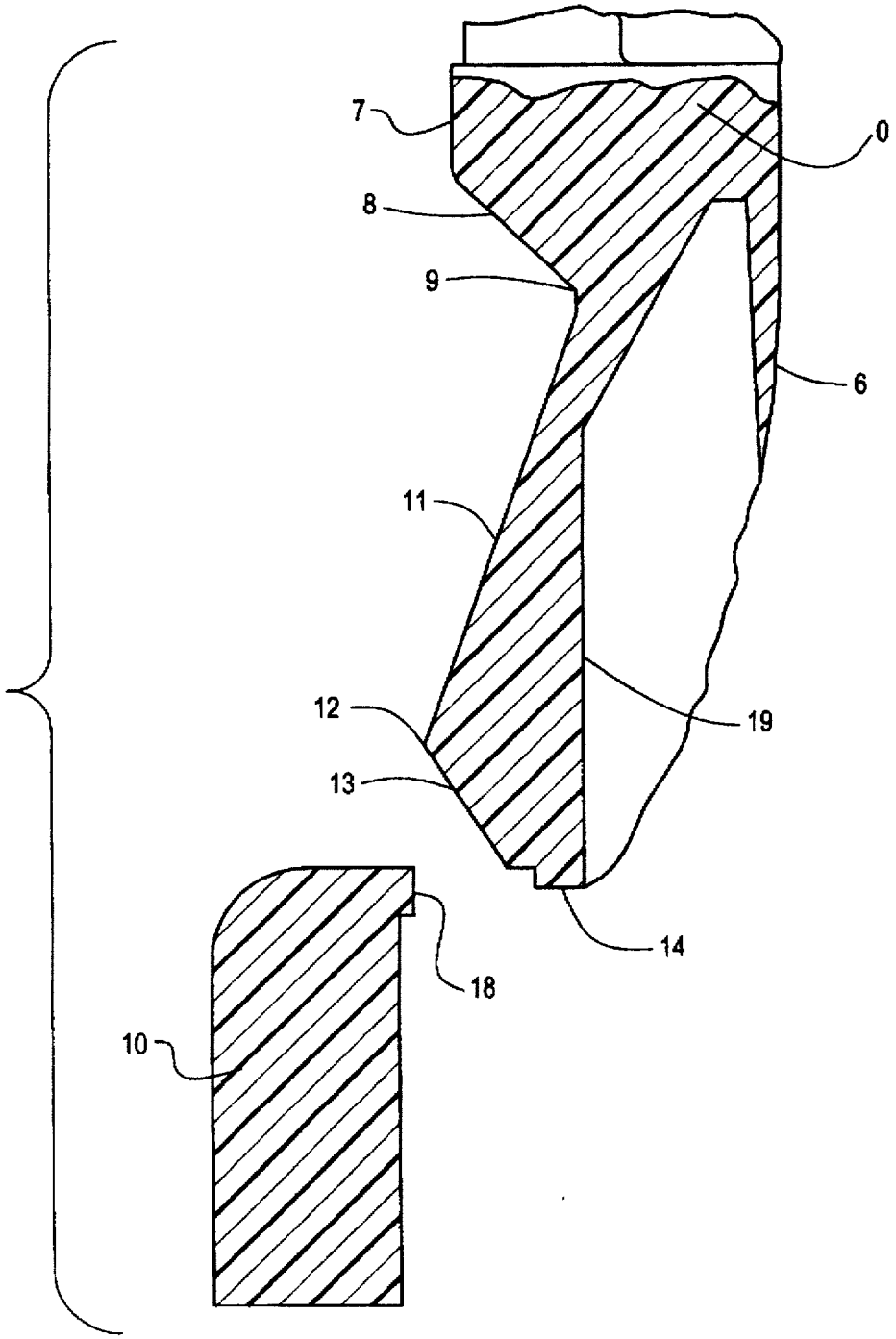
FIG. 8 shows the special development of the plunger plate and its arrangement in combination with the sleeve in the injection moulding.

This development is explained in more detail with reference to FIG. 8:

The plunger plate (0) has a surrounding stabilizing surface (7), which counteracts any tilting of the propelling element (1), at its upper end which is firmly connected to the propelling element (1), which surface continues downwards to a surface (8) which runs obliquely inwards as far as an elbow (9). Starting from this elbow, there is a wall surface (11) which runs obliquely outwards and, at its end, forms a further surrounding sealing surface (12). Starting from said sealing surface, a further wall surface (13) runs obliquely inwards as far as the surrounding inner edge (14).

After breaking off the sprue links (5) and pressing the propelling element (1) into the sleeve (10), the plunger plate (0) can engage by means of the inner edge (14) in a surrounding inner groove (18) in this sleeve. In this way, the plunger is prevented from being pulled out of the sleeve (10).

According to a preferred embodiment, the inside of the plunger plate, below the elbow (9), has a surface (19) which runs parallel to the axis of the plunger and extends as far as the inner edge (14).

Figure 9:
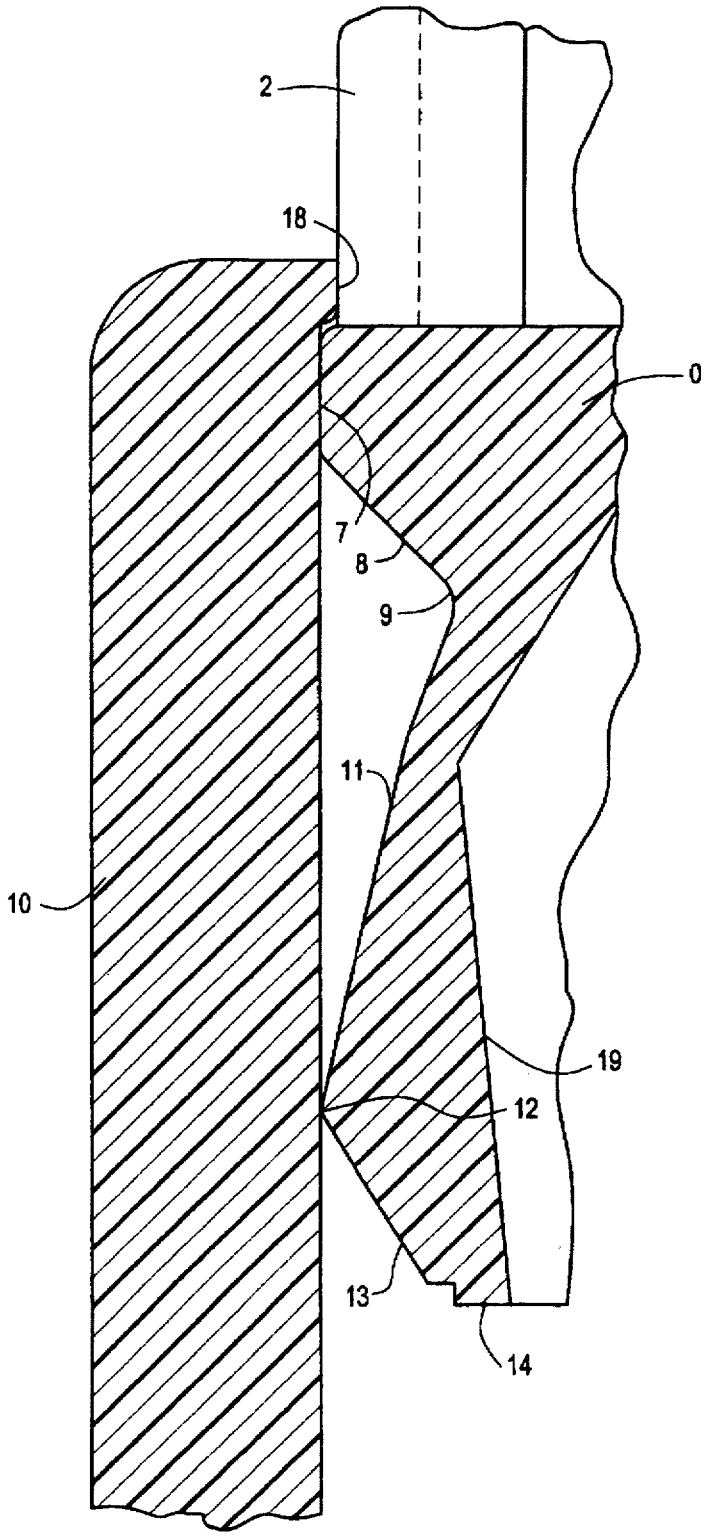
FIG. 9 shows the interaction of the plunger plate with the inside wall of the sleeve during the upward and downward moving.

As is shown by FIG. 9, this form of the plunger plate (0) is well matched to the sleeve (10) as the plunger plate is pushed further into said sleeve. The surface (19) is bent inwards in the process and together with the edge (14) thus forms a rear grip and therefore an additional anchorage for the stick composition, so that the latter can also be retracted by an axial movement of the propelling element (1).

For use, the consumer manually presses on the pressure plate (3), whereby the plunger moves into the sleeve (10) and the adhesive stick moves in the direction of the open sleeve end. The form of the plate-shaped element (1) has the effect of preventing the stick from tilting, given the form of an ellipse, over the longitudinal axis $\alpha$ of the same. At the same time, the shape of the reinforcing webs (2) prevents the plunger from tilting over the short axis $\beta$ of the stick ellipse. The. surfaces (4) and (7) on the plunger circumference also counteract canting of the plunger, as is evident from FIG. 6.

It is also evident from the final position reproduced in FIG. 7 that both the plate-shaped propelling element (1) and the reinforcing webs (2) fit snugly against the inside wall of the sleeve (10) and consequently enhance the guidance of the plunger.

What is claimed is:

1. An adhesive stick having:

1. a member in plunger form for retaining a stick adhesive composition, 2. a sleeve enclosing the stick composition, and 3. a propelling device for an upward and downward moving of the stick composition, wherein:

a. the plunger sleeve, b. the plunger with plunger plate and c. a propelling element, configured as a plate, which element at the same time constitutes an actuating element;

form a unit in a form of an injection moulding, and wherein a plate-shaped propelling element is bonded on two sides to the plunger plate via reinforcing webs and having, at a vertex, a pressure plate, in that a surrounding surface is further provided on the propelling element above the plunger plate, and wherein the plunger plate has on its side anchorage elements, in the form of bristles protruding into the sleeve and adapted to engage and anchor the adhesive stick composition during upward and downward moving of the adhesive stick composition.

2. The adhesive stick according to claim 1, wherein, after ejection from an injection-moulding machine, the injection moulding is firmly connected to an inside of the sleeve by means of sprue links at the lower edge of the plunger plate.

3. The adhesive stick according to claim 1, wherein the plunger plate has a surrounding surface at an upper end which is firmly connected to the propelling element, which surface continues downwards to a surface which runs obliquely inwards as far as an elbow, wherein, starting from the elbow, there is a wall surface which runs obliquely outwards and, at its end, forms a further surrounding sealing surface, starting from which a wall surface runs obliquely inwards as far as the surrounding inner edge.

4. The adhesive stick according to claim 3, wherein an inside of the plunger plate, below the elbow, has a surface which runs parallel to a longitudinal axis of the plunger and extends as far as the inner edge.

5. The adhesive stick according to claim 1, wherein the plate-shaped propelling element has, in each case, bosses in an upper part of the reinforcing webs.

6. The adhesive stick according to claim 1, wherein the surrounding surface has bosses.

7. The adhesive stick according to claim 1, wherein the plate-shaped propelling element has a gripping cavity in an upper part.

8. The adhesive stick according to claim 1, wherein the sleeve has an inner groove at its edge which is in engagement with the plunger plate.

9. The adhesive stick according to claim 1, wherein a snap ring for fitting on a fit-on cap is provided at a lower open end of the sleeve, with the fit-on cap having gripping ribs on its outside.

* * * * *